US008827647B1

(12) United States Patent
Liang

(10) Patent No.: US 8,827,647 B1
(45) Date of Patent: Sep. 9, 2014

(54) TURBINE BLADE WITH ROOT SECTION COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 457 days.

(21) Appl. No.: 12/822,226

(22) Filed: Jun. 24, 2010

(51) Int. Cl.
*F01D 5/18* (2006.01)

(52) U.S. Cl.
CPC ..... *F01D 5/187* (2013.01)
USPC ..... 416/97 R

(58) Field of Classification Search
CPC ..... F01D 5/187
USPC ..... 416/96 R, 97 R, 193 A, 298
See application file for complete search history.

(56) References Cited

U.S. PATENT DOCUMENTS 6,257,830 B1 * 7/2001 Matsuura et al. ..... 416/96 R
7,488,156 B2 * 2/2009 Liang ..... 416/97 R
7,547,191 B2 * 6/2009 Liang ..... 416/97 R

* cited by examiner

*Primary Examiner* — Ned Landrum
*Assistant Examiner* — Woody A Lee, Jr.
(74) *Attorney, Agent, or Firm* — John Ryznic

(57) ABSTRACT

A turbine rotor blade with a four-pass aft flowing serpentine flow cooling circuit with a first leg located along the leading edge and the fourth leg located along the trailing edge region, and with two exit slots connected to the fourth leg with one exit slot opening on the trailing edge just above the platform and the second exit slot opening just below the platform.

7 Claims, 3 Drawing Sheets

TURBINE BLADE WITH ROOT SECTION COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to turbine rotor blade with root section cooling.

2. Description of the Related Art Including Information Disclosed Under 37 CFR 1.97 and 1.98

A gas turbine engine, such as a large frame heavy duty industrial gas turbine (IGT) engine, includes a turbine with one or more rows of stator vanes and rotor blades that react with a hot gas stream from a combustor to produce mechanical work. The stator vanes guide the hot gas stream into the adjacent and downstream row of rotor blades. The first stage vanes and blades are exposed to the highest gas stream temperatures and therefore require the most amount of cooling.

The efficiency of the engine can be increased by using a higher turbine inlet temperature. However, increasing the temperature requires better cooling of the airfoils or improved materials that can withstand these higher temperatures. Turbine airfoils (vanes and blades) are cooled using a combination of convection and impingement cooling within the airfoils and film cooling on the external airfoil surfaces.

A turbine rotor blade, especially for a blade used in a large frame heavy duty industrial gas turbine engine, includes an airfoil extending from a platform to form a hot gas stream flow path around the blade. To limit stress, a fillet is formed between a transition from the airfoil wall to the platform surface and extends around the leading edge (L/E) of the blade and along both the pressure side (P/S) and suction side (S/S) walls of the airfoil. For the blade trailing edge (T/E) root section, due to migration of the hot gas flow from the blade upper span down to the T/E around the platform region, the blade aft fillet region will experience a hotter gas temperature. Also, at the blade T/E fillet location, a higher heat transfer coefficient or heat load onto the fillet location due to the T/E wake effect will occur. With a higher heat load on the airfoil root section, and a stress concentration issue, the cooling slot for the airfoil T/E root section cannot be located low enough into the blade root section fillet region to provide adequate convection cooling. Cooling of this particular airfoil T/E base region fillet location becomes very difficult. High thermally induced stress is predicted at the junction of the blade T/E and the platform locations. In addition, due to the different effectiveness level of cooling used for the blade and the platform cooling and also because of the mass metal distribution between the blade and the platform, the thermally induced strain during a transient cycle becomes much more severe.

BRIEF SUMMARY OF THE INVENTION

A turbine rotor blade with a four-pass serpentine flow cooling circuit that provides cooling air to a first root exit slot located above a platform surface along the trailing edge and a second root exit slot located below the platform. The four-pass serpentine includes a first leg located along the leading edge of the airfoil, with the remaining legs flowing aft toward the trailing edge to provide cooling for the airfoil.

DETAILED DESCRIPTION OF THE INVENTION

The turbine rotor blades of the present invention is for use in a large frame heavy duty industrial gas turbine engine that operates continuously for long periods of time and therefore requires adequate cooling for all surfaces to prevent metal temperatures from exceeding such limits that cause erosion of parts of the blade. However, the cooling air circuit could be used for an aero engine blade as well.

Figure 1:
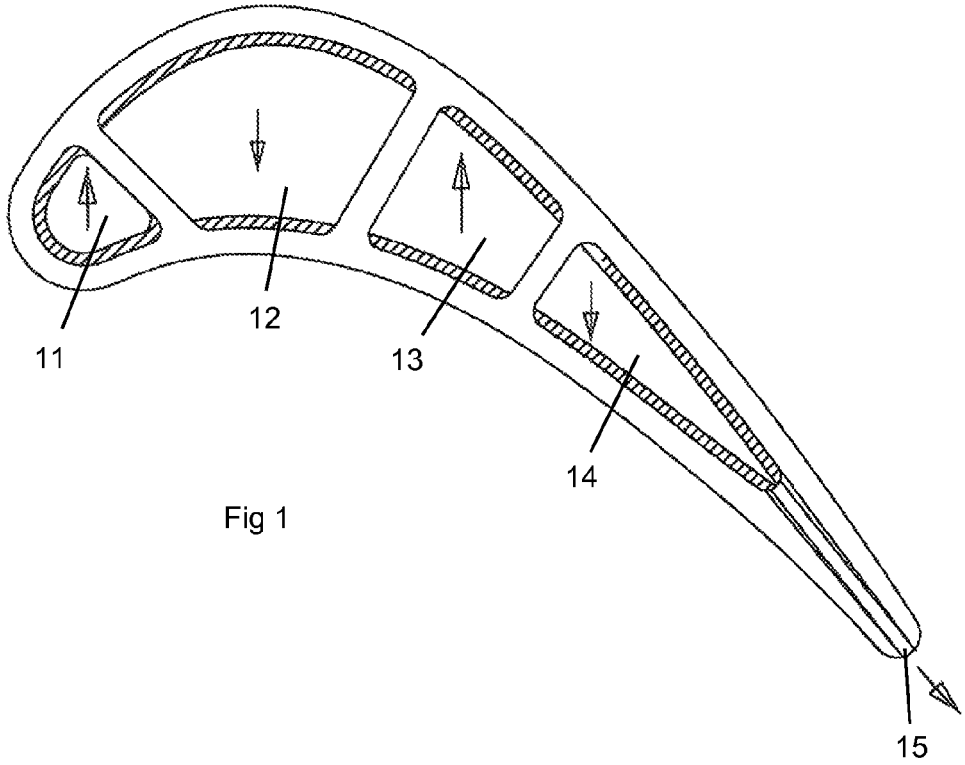
FIG. 1 shows a cross section view along a cut of the serpentine flow cooling circuit for the blade of the present invention.

FIG. 1 shows a view of the blade with a four-pass serpentine flow cooling circuit having a first leg 11 located along the leading edge, a second and third leg 12 and 13 located aftward from the first leg 11, and a fourth leg 14 located adjacent to a trailing edge region of the airfoil. The four-pass serpentine circuit is an aft flowing serpentine. Trip strips are used on the walls of each leg or channel to increase a heat transfer coefficient. The present embodiment uses a four-pass serpentine circuit but could use a different number of passes. However, the first leg must be an upward flowing channel and the last leg must be a downwardly flowing channel in order to cool the leading edge first and to discharge the cooling air from the exit slots around the platform on the trailing edge.

Figure 2:
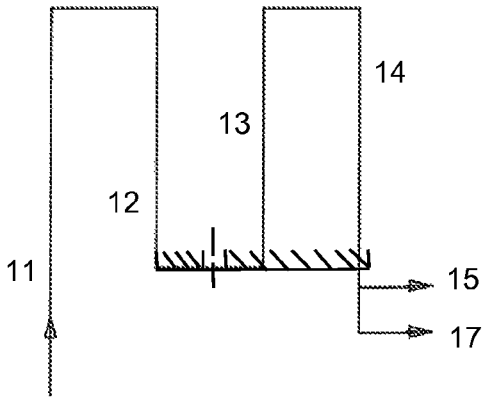
FIG. 2 shows a diagram view of the cooling air flow path for the blade of FIG. 1.
Figure 3:
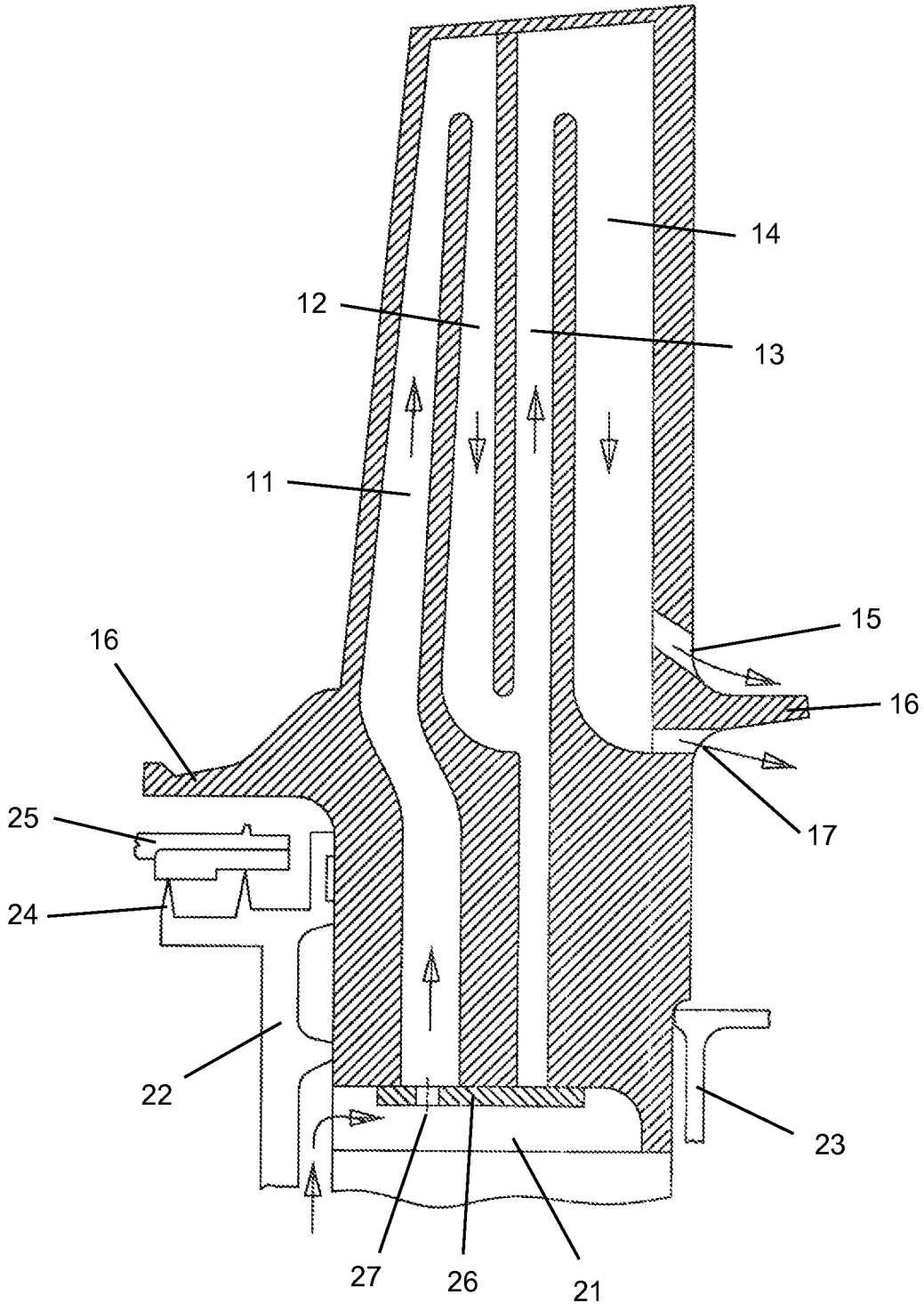
FIG. 3 shows a profile view from a side of the cooling air circuit of the blade of FIG. 1.

FIG. 2 shows a flow diagram for the four-pass serpentine flow cooling circuit of the blade in FIG. 1. Two exit slots 15 and 17 are used to discharge the cooling air passing through the serpentine circuit at a trailing edge of the blade above and below the platform 16. FIG. 3 shows a cross section view from the side for the blade cooling circuit. The four-pass serpentine flow cooling circuit is shown with the two exit slots 15 and 17 at the end of the fourth leg 14 located around the platform 16. A first exit slot 15 is located just above the platform 16 and the second exit slot 17 is located just below the platform 16. The channel or leg is curved along the bottom side so that the root section around the platform can be cooled.

Figure 4:
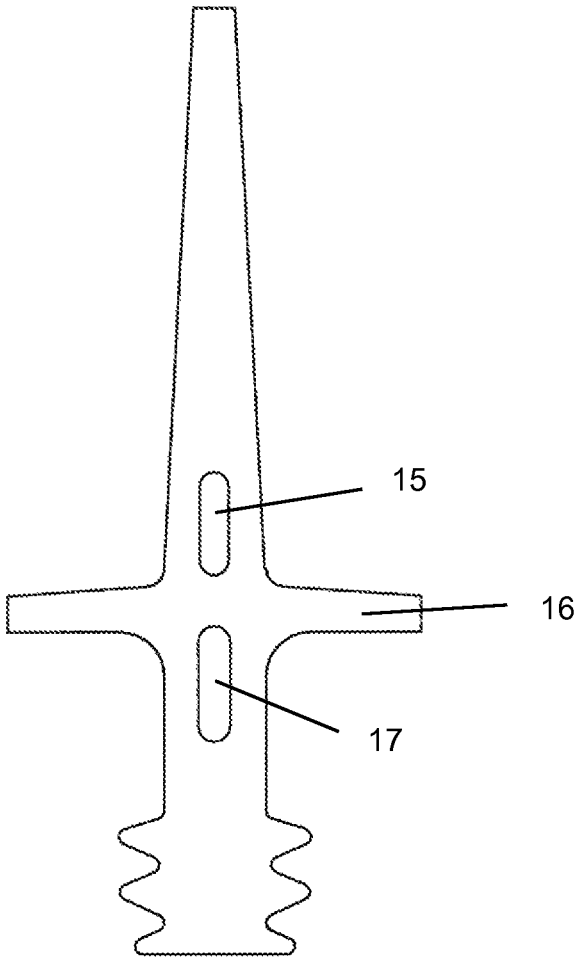
FIG. 4 shows a view from the trailing edge of the blade of FIG. 1 with the two root exit slots and the platform.

FIG. 3 also shows additional structure for the blade and its surroundings. A live rim cavity 21 receives cooling air from a cooling air inlet passage formed by the rotor disk and an upstream side cover plate 22 to channel the cooling air from an external source to the serpentine circuit within the blade. A metering plate 26 covers over the channels formed within the root of the blade and includes a metering hole 27 sized to meter a desired amount of cooling air from a pressurized external source and into the first leg 11 of the serpentine flow circuit. The cover plate 22 includes labyrinth teeth that form a labyrinth seal with a section 25 of an adjacent stator vane assembly. A cover plate 23 is also used on the downstream side of the rotor disk. FIG. 4 shows a view of the blade from the trailing edge side with the two exit slots 15 and 17 opening above and below the platform 16. The exit slot 17 below the platform is larger than the exit slot 15 above the platform in cross sectional flow area.

An improvement for the airfoil trailing edge fillet region cooling and high thermal strain issues can be achieved with the cooling circuit and exit slots of the present invention that also provides a reduction of the root stiffness below the airfoil trailing edge root section. This design also de-couples (thermally decouples the airfoil from the platform) the blade from the platform which lowers the fillet region metal temperature as well as the stiffness of the trailing edge root section which translates into a better flexibility for the blade trailing edge root section and a lower thermally induced strain.

Cooling air for the blade is fed from the blade dovetail, channeled through the airfoil leading edge section to provide airfoil leading edge section cooling first with fresh cooling air in the section of the airfoil that is exposed to the highest heat load. The cooling air then flows through the airfoil mid-chord section through multiple serpentine channels, and then into the last leg or channel located along the trailing edge region. A first exit slot discharges cooling air near the root section above the platform to provide cooling for the airfoil trailing edge corner. The remaining cooling air continues downward through the blade platform and then is discharged from the second exit slot located below the first exit slot and the platform. As a result of the double discharge of cooling air from the trailing edge root section, both sides of the platform are cooled and the stiffness for the airfoil trailing edge corner is reduced.

Major advantages for the cooling circuit and construction of the present invention are described below. A lower stress due to careful position of the two exit slots at the airfoil trailing edge root section. A higher cooling effectiveness due to the use of two exit slots with increased root section internal cooling convection area. This translates into a cooler root section fillet metal temperature and a higher blade LCF (low cycle fatigue) as well as a high blade HCF (high cycle fatigue) capability. Lower thermal gradient due to the two exit slots at the blade root section versus the platform junction. This translates into a lower thermal stress and strain range and a higher blade operating life. The second cooling discharge cooling slot undercuts the airfoil trailing edge corner location below the platform which softens the trailing edge stiffness and enhances the airfoil LCF capability. The two root discharge slots provide additional support to the serpentine ceramic core used during the casting process to form the blade. This results in a better production yield for the blade with less defective cast parts.

I claim the following:

1. A turbine rotor blade comprising:

an airfoil extending from a platform and a root;

the airfoil having a leading edge and a trailing edge with a pressure side wall and a suction side wall extending between the two edges;

a multiple-pass serpentine flow cooling circuit formed within the airfoil;

a first leg of the multiple-pass serpentine circuit extending along the leading edge of the airfoil and a last leg of the multiple-pass serpentine circuit extending along a trailing edge region of the airfoil;

the first leg being an upward flowing leg and the last leg being a downward flowing leg;

a first exit slot connected to the last leg and opening onto the trailing edge just above the platform;

a second exit slot connected to the last leg and opening onto the trailing edge just below the platform; and, the first exit slot and the second exit slot both providing cooling to a fillet section of the airfoil.

2. The turbine rotor blade of claim 1, and further comprising:

the multiple-pass serpentine flow cooling circuit is a four-pass serpentine flow cooling circuit.

3. The turbine rotor blade of claim 1, and further comprising:

the second exit slot is of larger cross sectional flow area than the first exit slot.

4. The turbine rotor blade of claim 1, and further comprising:

the blade is without film cooling holes.

5. The turbine rotor blade of claim 4, and further comprising:

the blade cooling circuit is such that all of the cooling air that enters the first leg is discharged out the two exit slots.

6. The turbine rotor blade of claim 1, and further comprising:

the first exit slot is directed to discharge cooling air onto a surface of the platform.

7. The turbine rotor blade of claim 1, and further comprising:

the first exit hole is angled toward the platform.

* * * * *